US009491970B2

(12) United States Patent
Shinozaki et al.

(10) Patent No.: US 9,491,970 B2
(45) Date of Patent: Nov. 15, 2016

(54) PAPER TUBE AND FLAVOR INHALER

(71) Applicant: JAPAN TOBACCO INC., Tokyo (JP)

(72) Inventors: Yasuhiro Shinozaki, Tokyo (JP); Yosuke Azegami, Tokyo (JP); Takeshi Akiyama, Tokyo (JP); Manabu Yamada, Tokyo (JP); Takashi Hasegawa, Tokyo (JP); Masafumi Tarora, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 104 days.

(21) Appl. No.: 14/367,334

(22) PCT Filed: Dec. 20, 2012

(86) PCT No.: PCT/JP2012/083054
§ 371 (c)(1),
(2) Date: Jun. 20, 2014

(87) PCT Pub. No.: WO2013/094681
PCT Pub. Date: Jun. 27, 2013

(65) Prior Publication Data

US 2014/0366901 A1 Dec. 18, 2014

(30) Foreign Application Priority Data

Dec. 21, 2011 (JP) ..... 2011-279868

(51) Int. Cl.
*A24D 1/00* (2006.01)
*A24D 1/02* (2006.01)
(Continued)

(52) U.S. Cl.
CPC ..... *A24D 1/002* (2013.01); *A24C 5/46* (2013.01); *A24D 1/02* (2013.01); *A24F 13/02* (2013.01); *A24F 47/002* (2013.01); *B31F 1/08* (2013.01)

(58) Field of Classification Search
USPC ..... 131/335, 337, 360, 365; 162/139
See application file for complete search history.

(56) References Cited

U.S. PATENT DOCUMENTS 1,967,262 A 7/1934 Robinson et al.
5,099,861 A * 3/1992 Clearman ..... A24F 47/004 131/194

(Continued)

FOREIGN PATENT DOCUMENTS

CA 2 474 924 A1 8/2003
CN 1078621 A 11/1993

(Continued)

OTHER PUBLICATIONS

Office Action issued in related Chinese Application No. 201280063299.4 on Aug. 31, 2015 (with English translation).

(Continued)

*Primary Examiner* — Dennis Cordray
(74) *Attorney, Agent, or Firm* — Birch, Stewart, Kolasch & Birch, LLP

(57) ABSTRACT

A paper tube that can be used in a flavor-suctioning tool. The paper tube (1) of a single layer of a thick paper is formed into a hollow cylinder shape by rolling a rectangular thick paper (2) into a cylindrical shape thereby forming an overlapped part (2*wr*) where two edges overlap, and by adhering the two edges to one another at the overlapped part (2*wr*). The thick paper (2) has a basis weight of 100 to 300 g/m$^2$, a thickness of 150 to 500 μm, and a density of 0.5 g/cm$^3$ or greater. The diameter of the cylinder is 5 mm to 8 mm. A plurality of grooves (3) that are parallel to an axis (CL) of the cylinder are disposed in the outer circumferential surface or the inner circumferential surface of the cylinder.

35 Claims, 9 Drawing Sheets

(51) Int. Cl.

| | |
|---|---|
| ***A24C 5/46*** | (2006.01) |
| ***A24F 13/02*** | (2006.01) |
| ***B31F 1/08*** | (2006.01) |
| ***A24F 47/00*** | (2006.01) |

(56) References Cited

U.S. PATENT DOCUMENTS

| | | | | |
|---|---|---|---|---|
| 5,348,027 | A * | 9/1994 | Barnes | A24F 47/004 131/194 |
| 5,396,911 | A * | 3/1995 | Casey, III | A24B 15/14 131/194 |
| 6,904,917 | B2 | 6/2005 | Kitao et al. | |
| 6,976,493 | B2 * | 12/2005 | Chapman | A24D 1/025 131/349 |
| 7,624,739 | B2 * | 12/2009 | Snaidr | A24B 15/28 131/187 |
| 8,061,361 | B2 | 11/2011 | Maeder et al. | |
| 8,118,033 | B2 | 2/2012 | Sendo et al. | |
| 2002/0005207 | A1 | 1/2002 | Wrenn et al. | |
| 2004/0020500 | A1 | 2/2004 | Wrenn et al. | |
| 2004/0149298 | A1 | 8/2004 | Moffitt | |

FOREIGN PATENT DOCUMENTS

| | | | |
|---|---|---|---|
| CN | 1287695 | C | 12/2006 |
| CN | 101778578 | A | 7/2010 |
| CN | 101925403 | A | 12/2010 |
| EP | 0 160 380 | A1 | 11/1985 |
| EP | 0 569 964 | A2 | 11/1993 |
| JP | 697982 | B2 | 12/1994 |
| JP | 3782394 | B2 | 6/2006 |
| JP | 4530371 | B2 | 8/2010 |
| JP | 2010-535530 | A | 11/2010 |
| JP | 4740506 | B2 | 8/2011 |
| WO | WO 2009-094859 | A1 | 8/2009 |

OTHER PUBLICATIONS

Extended European Search Report issued on Jun. 3, 2015 in corresponding EP Application No. 12858868.8.

* cited by examiner (a)

(b)

(a)

(b)

PAPER TUBE AND FLAVOR INHALER

TECHNICAL FIELD

The present invention relates to a paper tube suitable for a holder of a flavor inhaler having a heat source and a flavor inhaler using such a paper tube.

BACKGROUND ART

Recently, various proposals are made for a flavor inhaler, which has a heat source (a carbon heat source) at an end, heating a flavor generating source by use of heat generated from the heat source. For example, the flavor inhaler according to Japanese Patent Application Publication No. 2010-535530 has an enhanced chamber provided at a downstream of an aerosol generating base (a flavor generating source) and structure adopting a hollow thick paper tube (a paper tube) as the enhanced chamber.

The above described hollow thick paper tube is provided for adjusting a total length of article, cooling aerosol generated by heating, or the like. In Japanese Patent Application Publication No. 2010-535530, there is no specific description about the adopted paper chamber. However, the flavor inhaler disclosed herein is used by a user in a pinched (clipped) state as same as a general cigarette (a paper-wrapped tobacco). Therefore, it may be assumed that the thick paper tube has stiffness which does not crash easily when a force applied by fingers weakly pinching the thick paper tube, and has fire resistance and heat resistance.

Here, a general paper tube includes a spiral paper tube or a planospiral paper tube. The spiral paper tube is a paper tube where a thin paper is rolled around a shaft called a mandrel up to a predetermined thickness. The planospiral paper tube includes a multiple layered type manufactured by rolling a rectangular (a box-shaped) paper in a perpendicular direction relative to an axis of the mandrel, the thin paper being rolled up to a predetermined thickness as same as the spiral type, and a single layered type manufactured by curving a single thick paper into a cylindrical shape and overlapping a part of edge portions of sides facing each other.

As described above, there are various types of paper tubes, the paper tube where the thin paper is rolled in a multi-layered manner is manufactured by applying an adhesive on whole surface of paper. On the other hand, the flavor inhaler has a configuration that the flavor generating source is arranged inside the paper tube. Therefore, as the flavor inhaler partially includes the paper tube having large amount of the adhesive, a large amount of the flavor component is absorbed by the adhesive and there is concern that a sufficient amount of flavor cannot be provided to the user.

The above concern may be preferably solved by the planospiral paper of the single layered type where a few amount of the adhesive is used at the overlapped portion. However, there is a background that the planospiral paper of the single layered type is applied for an article having relatively large inner diameter such as a container (a box) for hat.

The reason is that the thick paper generally has high stiffness and lacks flexibility. Accordingly, when trying to form the paper tube having small inner diameter, it depends on the basis weight and the thickness, the troubles are caused such that the adhesion of the overlapped portion is broken due to repulsive force of the thick paper or that creases are easily formed on a surface of the paper tube. Therefore, it is extremely difficult to manufacture the planospiral paper of small diameter (10 mm level at the maximum), which is same as a general cigarette, with the single layered thick paper.

SUMMARY AND OBJECTS OF THE INVENTION

The object of the present invention is to provide a paper tube preferably adopted for a flavor inhaler and a flavor inhaler adopts such a paper tube as a holder (a paper tube holder) for holding composition element.

The above problem is achieved by a paper tube of a single layered thick paper formed into a cylindrical hollow body by curving a thick paper having a rectangular shape and gathering both side edge portions of the thick paper, wherein the thick paper has a basis weight equal to 100 g/m$^2$ or more and equal to 300 g/m$^2$ or less, a thickness equal to 150 μm or more and equal to 500 μm or less, and a density equal to 0.5 g/cm$^3$ or more, and a diameter of the cylindrical hollow body is equal to 5 mm or more and equal to 8 mm or less, a plurality of grooves parallel to an axis line of the cylindrical hollow body is formed on an outer surface or an inner surface of the cylindrical hollow body.

A configuration may be adopted that an overlapped portion may be formed by overlapping the side edge portions and adhering the both side edge portions.

A configuration may be adopted that the cylindrical hollow body is formed by facing edge ends of the side edge portions and by adhering the side edge portions using a sealing member bridging the side edge portions.

The grooves each may include a cut portion of a linear shape formed by removing a part of the thick paper in a linear manner along the axis line of the cylindrical hollow body or a recessed indentation of linear shape formed on the surface of the thick paper along the axis line of the cylindrical hollow body.

The grooves may be preferably arranged having equal intervals in a sense of a circumferential direction of the cylindrical hollow body. A depth of each groove may be preferably equal to 60% or more and equal to 90% or less of the thickness of the thick paper, and an interval between a pair of grooves adjacent to each other may be preferably equal to 1 mm or more and equal to 2 mm or less.

The side edge portions may be preferably adhered by an adhesive for a food-related material selected from a group of a CMC-Na, a vinyl acetate, an EVA, a pullulan and a pectin. The thick paper may be preferably made by a paper making process without using a binder.

The above problem is achieved by a flavor inhaler comprising: any one of above paper tube, a heat source held at a one end of the paper tube, and a flavor generating source arranged in the paper tube, which generating a flavor using heat generated from the heat source.

The flavor inhaler may comprise a cooling element arranged between the heat source and the flavor generating source, which cooling heated air heated by the heat source and traveling toward the flavor generating source.

The flavor inhaler may include the paper tube as a reinforce ember of an inside hollow portion or a positioning member of a composition element.

As a paper tube according to the invention is a single layered type where a single thick paper is curved into a cylindrical shape and both side edge portions of the thick paper are gathered, and includes a plurality of grooves parallel to an axis line, it is possible to provide a new paper tube having small diameter while reducing an used amount of adhesive and improving flexibility. As the paper tube uses small amount of the adhesive, it can reduce an influence caused by a sorption of a flavor component by the adhesive and also it can reduce a detachment of an overlapped portion and a formation of creases on a surface of the paper tube, the paper tube is preferable for a holder holding a composition element included in a flavor inhaler.

Accordingly, the flavor inhaler adopting such a planospiral paper tube of a single layered thick paper having small diameter can keep its form stably by stiffness of the thick paper, reduce an influence for a flavor from the adhesive, and has a merit to reduce a manufacturing cost compared to a case where the holder is made of other material such as a metal or a plastic.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, a preferable embodiment of the present invention is described with reference to the drawings.

Figure 1:
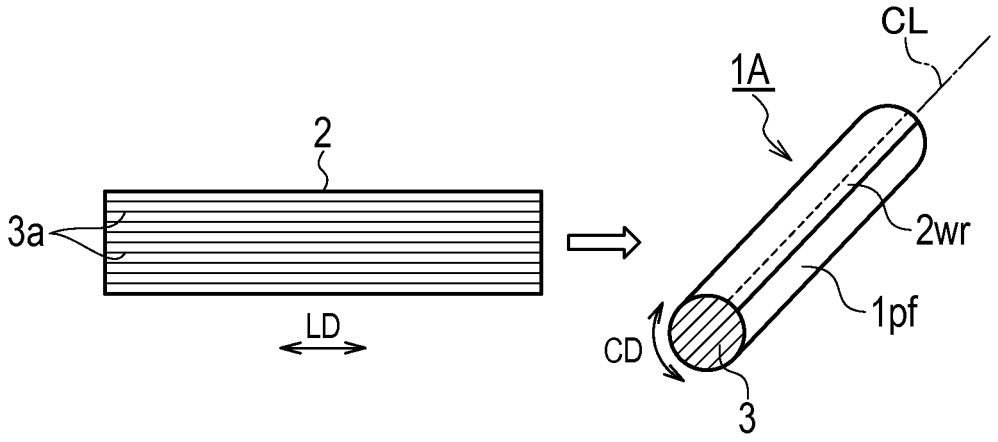
FIG. 1 is a schematic view illustrating a process of manufacturing a paper tube according to the present invention.

FIG. 1 is a schematic view illustrating a process of manufacturing a paper tube according to the present invention.

A paper tube according to the present invention is formed into a cylindrical hollow body by curving a thick paper 2 having a rectangular shape and gathering both side edge portions of the thick paper 2.

The paper tube according to the present invention may include a cylindrical hollow body formed by simply contacting the edge ends (sides) of the side edge portions, which faces each other when curving the thick paper, without forming an overlapped portion and a cylindrical hollow body formed by overlapping the side edge portions. Further, in a case where the cylindrical hollow body is provided with the overlapped portion, it includes a formation of adhering the overlapped portion and a formation of not adhering the overlapped portion.

Here, a cylindrical shape will be described as a preferable paper tube 1A, the cylindrical shape has an overlapped portion 2*wr* formed by overlapping side edge portions each other and adhering the same. That is, the paper tube 1A is formed into the cylindrical hollow body by adhering the side edge portions at the overlapped portion 2*wr*. Such a structure is same as a conventional planospiral paper tube formed by a single (layered) thick paper. However, the paper tube 1A shown hereinafter is a new paper tube having small diameter which is considerably small and same as a cigarette.

Hereinafter, the paper tube preferable for a holder adopted for the flavor inhaler will be described specifically.

The thick paper 2 preferably has a basis weight equal to 100 g/m$^2$ or more and equal to 300 g/m$^2$ or less, a thickness equal to 150 μm or more and equal to 500 μm or less, and a density equal to 0.5 g/cm$^3$ or more. More preferably, the thick paper 2 has the basis weight equal to 200 g/m$^2$ or more and the thickness equal to 250 μm or more. The thick paper 2 is preferably a thick paper made by a paper making process without using a binder.

The thick paper 2 is provided with a plurality of linear cut portions 3*a* formed along a longitudinal direction LD, the linear cut portions 3*a* corresponding to a plurality of grooves 3 parallel to an axis line CL in a state of the paper tube 1A of the cylindrical hollow body. As shown in the drawing, the linear cut portions 3*a* preferably formed along the entire length from one end to another end. The plurality of the grooves 3 are arranged having equal intervals in a sense of a circumferential direction CD of the paper tube 1A of the cylindrical hollow body to uniformize stiffness (strength), the structure can be achieved that has even renitency against external force applied from any directions. The interval of the grooves 3 may be equal to 1 mm or more and equal to 2 mm or less.

Although FIG. 1 shows the paper tube 1A having the grooves 3 formed on an inner surface (inside) of the paper tube 1A, the grooves 3 may be formed on an outer surface (outside) of the paper tube 1A if needed.

Here, the linear cut portions 3*a* of linear shape formed on the surface of the thick paper 2 is preferably formed by removing a part of the surface in a linear manner. For example, the surface is removed in the linear manner by use of cutter. In this case, a shape of the grooves arbitrary adjusted by adjusting a cutting width (a groove width), a cutting angle and a cutting depth of the cutter may be adjusted in need. Thus formed grooves forms cutouts exists at approximately equal intervals in the sense of a circumferential direction, a flexibility can be improved at the curving. Therefore, the paper tube having small diameter can be manufactured form the thick paper having high stiffness.

Although the grooves 3 is formed as the linear cut portion 3*a* in the above description, the method for forming the grooves is not limited. For example, recessed indentations (indentation lines) extended along the axis line CL of the cylindrical hollow body can be formed as the grooves by pressing the surface of the thick paper with an indenter (a jig having a predetermined hardness or more and made for forming a recessed indentation of linear shape on the thick paper).

Since the paper tube 1A illustrated by an example is used as the flavor inhaler which is a substitute for luxury items like a cigarette (a paper-wrapped tobacco), a diameter of the paper tube 1A is a level equal to 5 mm or more and equal to 8 mm.

An adhesive used for adhering the overlapped portion 2*wr* is preferably an adhesive applicable for a food-related material, it is preferable to use the adhesive selected from a group of a CMC-Na, a vinyl acetate, an EVA, a pullulan and a pectin.

An overlap width of the overlapped portion 2*wr* is a level equal to 2 mm or more and equal to 4 mm or less when forming the paper tube 1A having the diameter equal to 5 mm or more and equal to 8 mm or less as described above, the above adhesive only used for adhering the overlapped portion 2*wr*. Accordingly, the above indicated problem caused by the adhesive may not arise since there is no need to use a large amount of the adhesive like the paper tube where a thin paper is rolled in a multi-layered manner.

Figure 2:
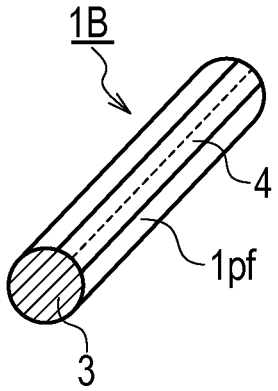
FIG. 2 is a schematic view illustrating another process of manufacturing a paper tube according to the present invention.

FIG. 2 is a schematic view illustrating another process of manufacturing a paper tube according to the present invention. In this method, a paper tube 1B of a cylindrical hollow body is formed by curving a thick paper 2 into the cylindrical shape and facing edge ends (sides) of side edge portions without forming an overlapped portion, and by adhering a sealing member 4 so as to bridge the side edge portions of the thick paper 2.

The sealing member 4 may be an elongated thin paper arranged to cover the side edge portions of the thick paper 2, for example. Subsequently, it may be adhered by the adhesive applicable for a food-related material as described above. The side edge portions of the thick paper 2 may be adhered by use of a tape member applicable for the food-related material and having sticking and adhering property itself. The paper tube 1B shown in FIG. 2 has no step or quite few step since it has no overlapped portion of the thick paper, and therefore it has an effect that a cylindrical hollow can be obtained that has more balanced uniform circumference.

Hereinafter, the flavor inhaler adopting the above described paper tube 1 (1A or 1B) as a holder (heretofore, paper tube holder) will be described. Such a flavor inhaler includes a flavor inhaler so-called smokeless type and a flavor inhaler so-called original type. The flavor inhaler of smokeless type has a cooling element for cooling heated air down to an appropriate temperature when inhaling the heated air heated by the heat source provided on one end, and reduces the aerosol to an invisible level.

Figure 3:
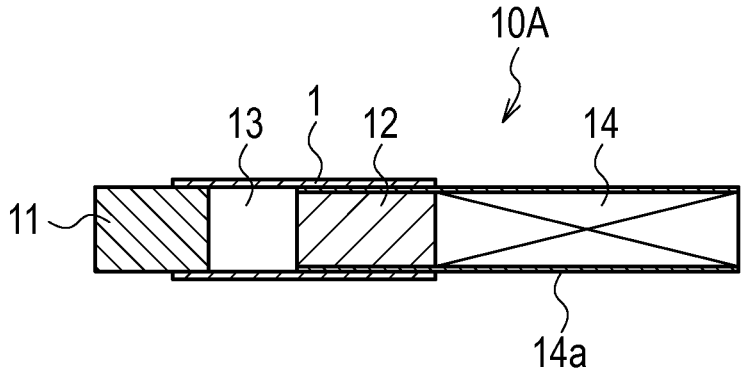
FIG. 3 is a view illustrating a flavor inhaler of a smokeless type adopting a paper tube shown in FIG. 1 as a paper tube holder.

A flavor inhaler 10A shown in FIG. 3 is aforementioned smokeless type, and at least includes a heat source 11, a flavor generating source 12 generating a flavor using heat generated from the heat source 11, and a cooling element 13 arranged between the heat source 11 and the flavor generating source 12, which cooling heated air heated by the heat source. A mouthpiece member 14 is connected to a downstream of the flavor generating source 12.

As the heat source 11, a shaped article can be preferably applicable that formed of a mixture including a carbon particle, an unburnable additive, an organic or inorganic binder and water, for example. As the flavor generating source 12, a general cut filler tobacco used for cigarette, a granular tobacco for snuff tobacco, a rolled tobacco, a shaped article formed of molded tobacco. Such a tobacco material may include a desirable flavor.

A crushable capsule housing a flavor component may be arranged in the flavor generating source 12. The capsule may be buried in the flavor generating source 12. The capsule may be arranged at an air gap formed between two separated flavor generating sources 12. A single capsule may be arranged or two or more capsule may be arranged as the capsule. The capsule is preferable formed of a coated layer including a low-volatile solvent like cooking oil, a gelatin and natural gum. A diameter of the capsule is preferably equal to 3.5 mm or more and equal to 5.5 or less.

The cooling element 13 is not limited if it has a configuration for reducing the temperature of the heated air passing through, for example, it may be a relative long penetration passage as a simple cooling space provided inside the paper holder 1. Note that a preferable embodiment of the cooling element 13 may be a configuration having an increased inner surface and formed of an inorganic material such as a ceramics, a meerschaum, a glass, a metal or a calcium carbonate, or a material such as a hydration material or an absorbent polymer. It is preferable to use a honeycomb structure, a foam structure or a filling structure. The filling structure can be obtained by filling a material of a granular or fibrous form into a mold.

In the flavor inhaler 10A, the paper tube 1 is arranged to cover and hold the end of the heat source 11, the cooling element 13, and the outer circumference of the flavor generating element 12. The mouthpiece member 14 needs to have a configuration that functions as a penetration passage guiding air flow into a mouth of user, that includes the flavor and passes through the flavor generating source 12, a filter may be adopted that is formed of an acetate fiber or a paper similar to the cigarette, for example. If a tip paper 14*a* covering an outer circumference of the filter is arranged to project toward the flavor generating source 12, it is possible to manufacture the flavor inhaler 10A entirely supported by the paper tube holder 1.

Figure 4:
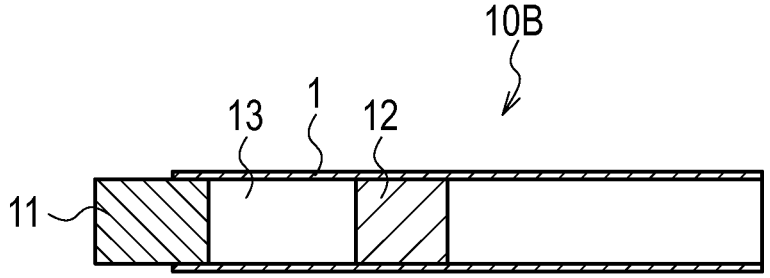
FIG. 4 is a view illustrating another flavor inhaler of a smokeless type adopting the paper tube shown in FIG. 1 as a paper tube holder.

FIG. 4 is a view illustrating another flavor inhaler 10B of a smokeless type. The paper tube according to the present invention can be manufactured to incorporate the function of the mouthpiece member 14 adopted for the flavor inhaler 10A. This is shown by the flavor inhaler 10B. The flavor inhaler 10B configured to incorporate the function of the penetration passage guiding air flow into the mouth of user as same as the above mouthpiece member 14, by extending the paper tube holder 1 toward a downstream of the flavor generating source.

For example, the filter formed of the acetate fiber or the paper may be arranged at the downstream end of the paper tube holder 1 if needed. According to such a flavor inhaler 10B, the tip paper 14*a* provided with the flavor inhaler 10A can be omitted.

The flavor inhalers 10A and 10B shown in FIGS. 3 and 4 utilize the paper tube according to the present invention as a framework of the structure. A usage of the paper tube according to the present invention is not limited to such a usage.

That is, the paper tube according to the present invention can be adopted to other part of the flavor inhaler. For example, it may be used as an annular reinforce member of a hollow portion provided inside the flavor inhaler or used as a positioning member of composition elements such as the heat source or the flavor generating source. For example, by arranging the paper tube of the present invention at a predetermine position inside the holder, i.e. a position of the cooling element 13, the hollow portion provided inside the flavor inhaler can be reinforced and the heat source and the flavor generating source can be arranged correctly at the predetermined position. The function of the reinforce member or the positioning member of the composition element may be expected by curving the thick paper 2 into arch shape without adhering both side edge portions and arranging the curved thick paper 2 inside the holder.

Hereinafter, a first modified embodiment of the first embodiment will be described. Hereinafter, the difference from the first embodiment will be described. An explanation of a composition same as the first embodiment will be omitted by using the same reference numeral.

In the first embodiment, the plurality of grooves 3 are formed parallel to the axis line CL of the thick paper 2. On the contrary, in the first modified embodiment, the plurality of grooves 3 are formed in a lattice shape on the thick paper 2.

Figure 5:
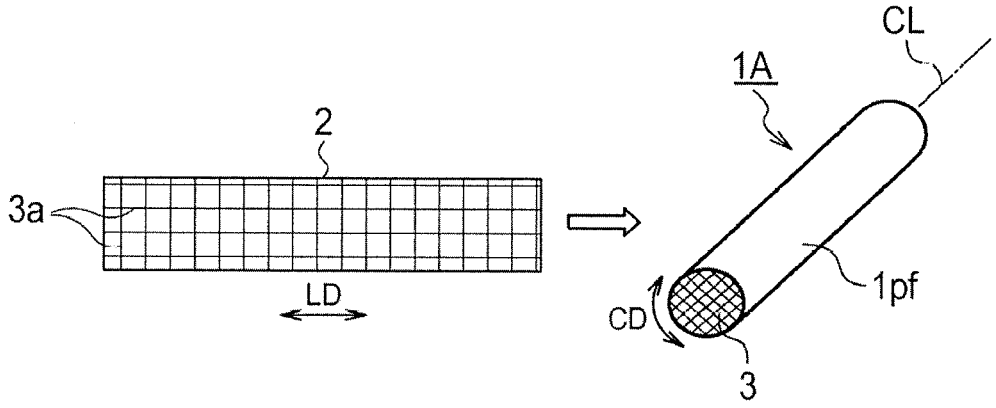
FIG. 5 is a schematic view illustrating a process of manufacturing a paper tube according to the first modified embodiment.

FIG. 5 is a schematic view illustrating a process of manufacturing a paper tube according to the first modified embodiment.

The linear cut portions 3*a* correspond to a plurality of grooves 3 in the lattice shape. The lattice shape means a state where multiple longitudinal lines and multiple lateral lines are intersecting each other, as same as so-called waffle pattern. As shown in the drawing, the linear cut portions 3*a* preferably formed along the entire length from one end to another end. The plurality of the grooves 3 are arranged having equal intervals in a sense of a circumferential direction CD of the paper tube 1A of the cylindrical hollow body to uniformize stiffness (strength), the structure can be achieved that has even renitency against external force applied from any directions. The interval of the grooves 3 may be equal to lmm or more and equal to 2 mm or less.

Although FIG. 5 shows the paper tube 1A having the grooves 3 formed on an inner surface (inside) of the paper tube 1A, the grooves 3 may be formed on an outer surface (outside) of the paper tube 1A if needed.

Hereinafter, an example of the paper tube according to the present invention will be described. The example is an example of applying the paper tube to the flavor inhaler, the paper tube formed with the overlapped portion and the overlapped portion being adhered.

A planospiral paper tube formed of a thick paper having a single layer according to the present invention was manufactured by obtaining six types of thick paper examples A to F shown in Table 1 form Tomoegawa Paper Co., Ltd. The thick papers used here are made by the paper making process without using the binder.

TABLE 1

| | Thick Paper Example | | | | | |
|---|---|---|---|---|---|---|
| | A | B | C | D | E | F |
| Basis Weight ($g/m^2$) | 119 | 160 | 182 | 199 | 203 | 290 |
| Thickness (μm) | 164 | 185 | 215 | 244 | 244 | 507 |
| Density ($g/cm^3$) | 0.73 | 0.87 | 0.85 | 0.82 | 0.83 | 0.57 |

Figure 6:
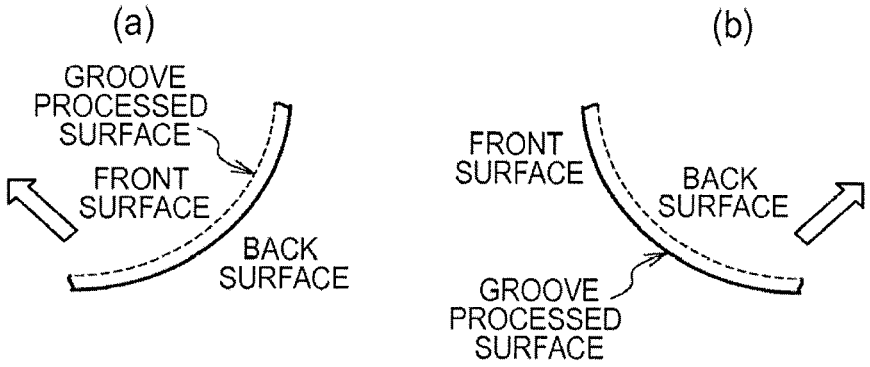
FIGS. 6(*a*) and 6(*b*) are views illustrating a measurement method for a bending moment of a thick paper.

The linear cut portions (refer to reference numeral 3*a* shown in left hand of FIG. 1) was formed on the surfaces of the thick papers A to F by use of cutter having intervals of 1 mm in a lateral direction (hereinafter called a half cut groove forming process). For each of the thick papers A to F that executed the half cut groove forming process, a bending moment was measured as an index of flexibility and repulsive force, when bending toward a front surface as shown in FIG. 6 (*a*) and bending toward a back surface as shown in FIG. 6 (*b*). Specifically, for each of the thick papers A to F, the samples having 70 mm*20 mm was prepared and the bending moment was measured by use of a digital taber type stiffness tester that is a measurement apparatus of Toyo Seiki Seisaku-sho, Ltd.

Figure 7:
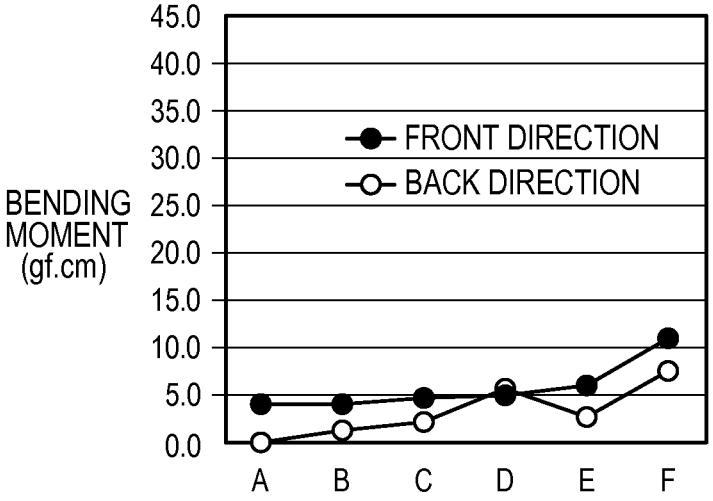
FIGS. 7(*a*) and 7(*b*) are views illustrating measurement results for bending moments of thick papers.
Figure 7:
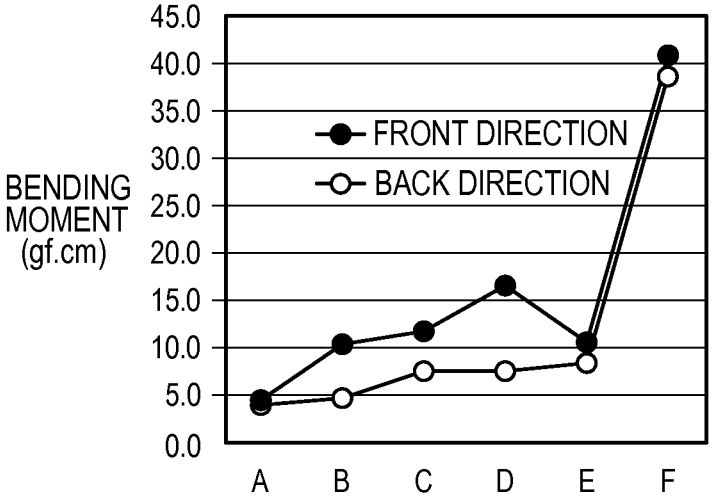

The measurement result is summarized in FIGS. 7(*a*) and 7(*b*). For each of the thick papers A to F, FIG. 7 (*a*) shows a graph when the groove forming process is applied and FIG. 7 (*b*) shows a graph when the groove forming process is not applied.

Regarding the thick paper D among the thick papers A to F, the paper tubes respectively having the diameter of 8.0 mm, 7.2 mm, 6.2 mm and 4.9 mm was prepared by rolling the paper having a length of 50 mm around an iron core having various diameters, for the sample where the groove forming process is applied and the sample the groove forming process is not applied. For each of the formed paper tubes, an appearance check was performed and the number of crimples (creases) formed on the surface of the paper tube for each piece was counted.

Results of the appearance check are shown in Table 2.

TABLE 2

| Length of Paper Tube (mm) | Diameter of Paper Tube (mm) | Number of Crease Formed on Surface of Paper Tube: Without Groove Forming Process | With Groove Forming Process |
|---|---|---|---|
| 50 | 4.9 | 40 | 0 |
| 50 | 6.2 | 38 | 0 |
| 50 | 7.2 | 28 | 0 |
| 50 | 8.0 | 30 | 0 |

As evidenced form FIGS. 7(*a*) and 7(*b*), it is confirmed that the bending moment toward the front surface and the back surface are reduced in every thick papers if the groove forming process is applied. That is, it is confirmed that the flexibility of the thick papers is improved and the thick papers become easy to bend.

Especially, the groove forming process for the thick paper reduces the bending moment mostly and makes the thick paper easy to bend when the grooves are formed to extend in the lateral direction (perpendicular to a paper making direction) on the surface of the thick paper (the front surface or the back surface of the paper). As evidenced from the results of the appearance check shown in above Table 2, it is possible to manufacture the paper tube having small diameter superior in the appearance that is even, has no formation of creases on the surface and has a stable stiffness, when making the planospiral paper tube formed of the single layer having small diameter such as 5 mm or more and 8 mm or less if using above thick paper.

As described above, the planospiral paper tubes formed of the single layer having small diameter were manufactured respectively using the thick papers A to F where the groove forming process is applied. Specifically, the planospiral paper tubes were manufactured by cutting each of the thick papers A to F into 100 mm in a length and 26 mm in a width, rolling it around an iron core having diameter (ϕ) of 6.5 mm, forming an overlapped portion of 2 mm, applying CMC-Na as the adhesive on the overlapped portion, and adhering and fixing it by heating (refer to FIG. 1).

Figure 8:
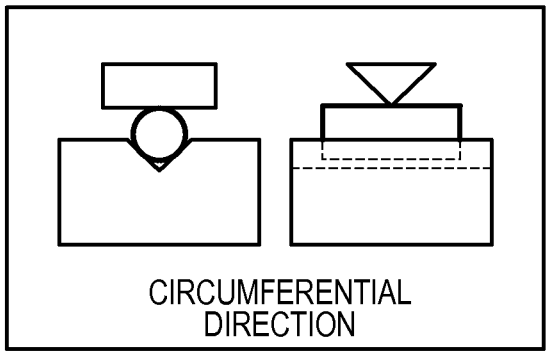
FIGS. 8(*a*) and 8(*b*) are views illustrating a process of measuring stiffness of the paper tube shown in FIG. 1.
Figure 8:
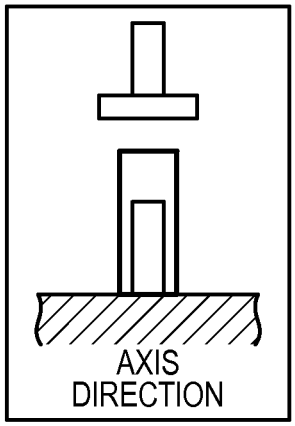

Test samples having 25 mm in a length was prepared by cutting each of the manufactured planospiral paper tubes, and stiffness in a circumferential direction of paper tube as shown in FIG. 8 (*a*) and stiffness in an axis direction of the paper tube as shown in FIG. 8 (*b*) were measured. Such a measurement was performed by using a desktop compact tester EZ test of Shimadzu Corporation.

Figure 9:
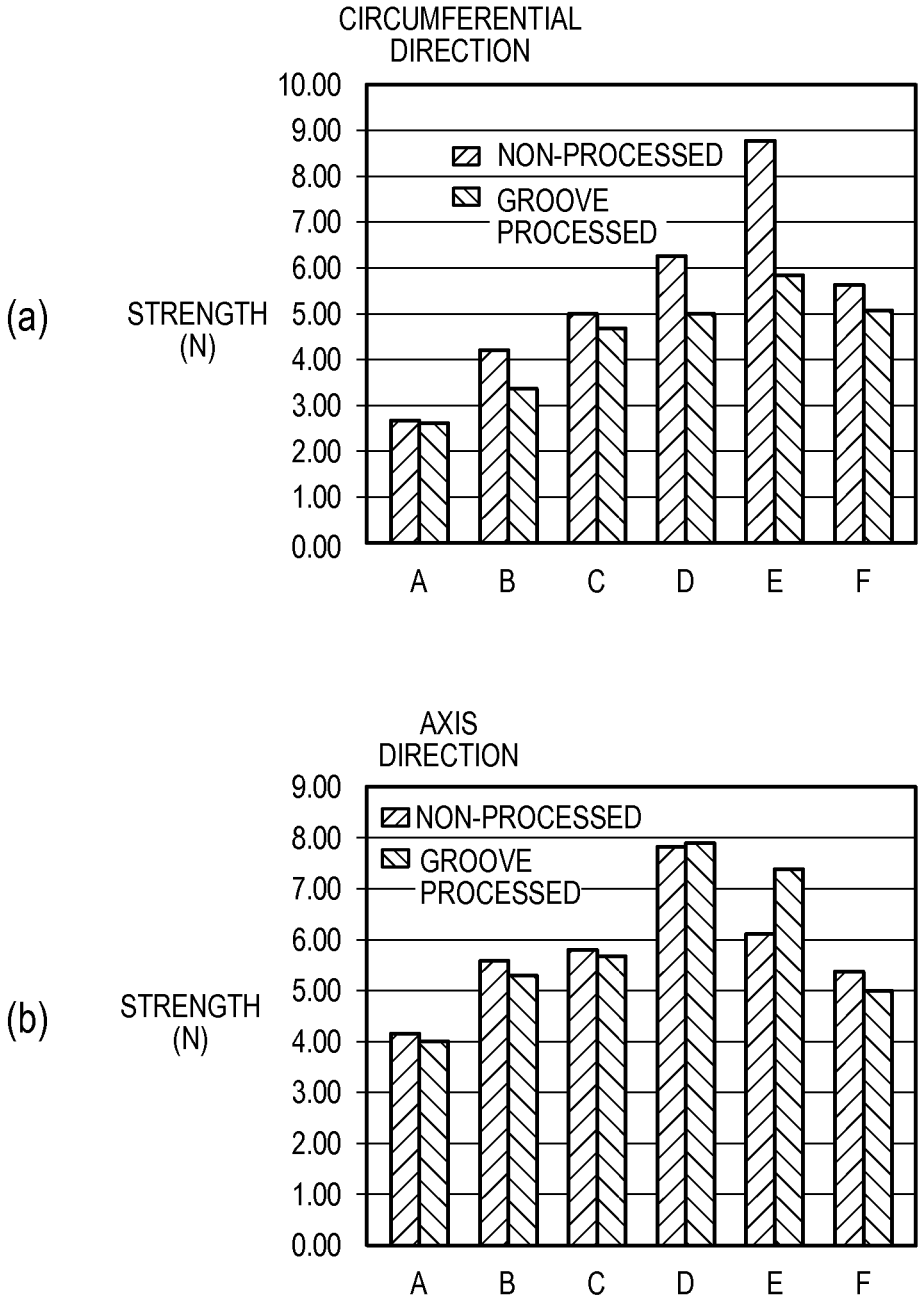
FIGS. 9(*a*) and 9(*b*) are views illustrating a summary of measurement results of stiffness of paper tubes.

The measurement results are summarized in FIGS. 9(*a*) and 9(*b*). For each of the thick papers A to F, FIG. 9 (*a*) shows a graph of strength (N) in the circumferential direction and FIG. 9 (*b*) shows a graph of strength (N) in the axis direction.

Further, for the thick paper D, using two type of groove forming method which are the half cut groove forming process and a method (hereinafter called indentation line forming process) for forming the groove by the recessed indentation (the indentation line) as shown in Table 3 described below, the planospiral paper tubes were manufactured by cutting each of the thick papers D1 to D8 having different depth of the groove into 100 mm in a length and 26 mm in a width, rolling it around an iron core having diameter (ϕ) of 6.5 mm, forming an overlapped portion of 2 mm, applying CMC-Na as the adhesive on the overlapped portion, and adhering and fixing it by heating (refer to FIG. 1). As a comparative example, a sample D0 was manufactured that has no groove.

As the method for forming the groove, a roller blade made of metal having a blade angle of 30 degrees was rolled on the thick paper while pressing it by a determined pressing depth from an upper surface of the thick paper. The blade having sharp blade edge was used in the half cut groove forming process and the blade having dull blade edge and not cutting a fiber of the thick paper was used in the indentation line forming process. Settings for the roller blade used for forming the groove on the samples D1 to D8 are shown in Table 3.

A parameter of "Distance from Lower Surface of Thick Paper to Blade Edge" shown in Table 3 represents "Thickness of Sample" minus "Depth of Blade". That is, it is calculated as 244−0=244 for no processed sample D0 since the depth of blade is equal to 0, and it represents the thickness of sample.

TABLE 3

| Name of Sample | Method for Generating Groove | Depth of Blade (μm) | Distance from Lower Surface of Thick Paper to Blade Edge (Thickness of Sample - Depth of Blade) (μm) | Blade Width at Upper Surface of Thick Paper (μm) | Ratio of Depth of Blade Relative to Thickness of Sample (%) |
|---|---|---|---|---|---|
| D0 | Non-Processed | 0 | 244 | 0 | 0% |
| D1 | Half Cut | 150 | 94 | 80 | 61% |
| D2 | Groove | 170 | 74 | 91 | 70% |
| D3 | Forming | 200 | 44 | 107 | 82% |
| D4 | Process | 220 | 24 | 118 | 90% |
| D5 | Indentation | 150 | 94 | 80 | 61% |
| D6 | Line | 170 | 74 | 91 | 70% |
| D7 | Forming Process | 200 | 44 | 107 | 82% |
| D8 | | 220 | 24 | 118 | 90% |

Figure 10:
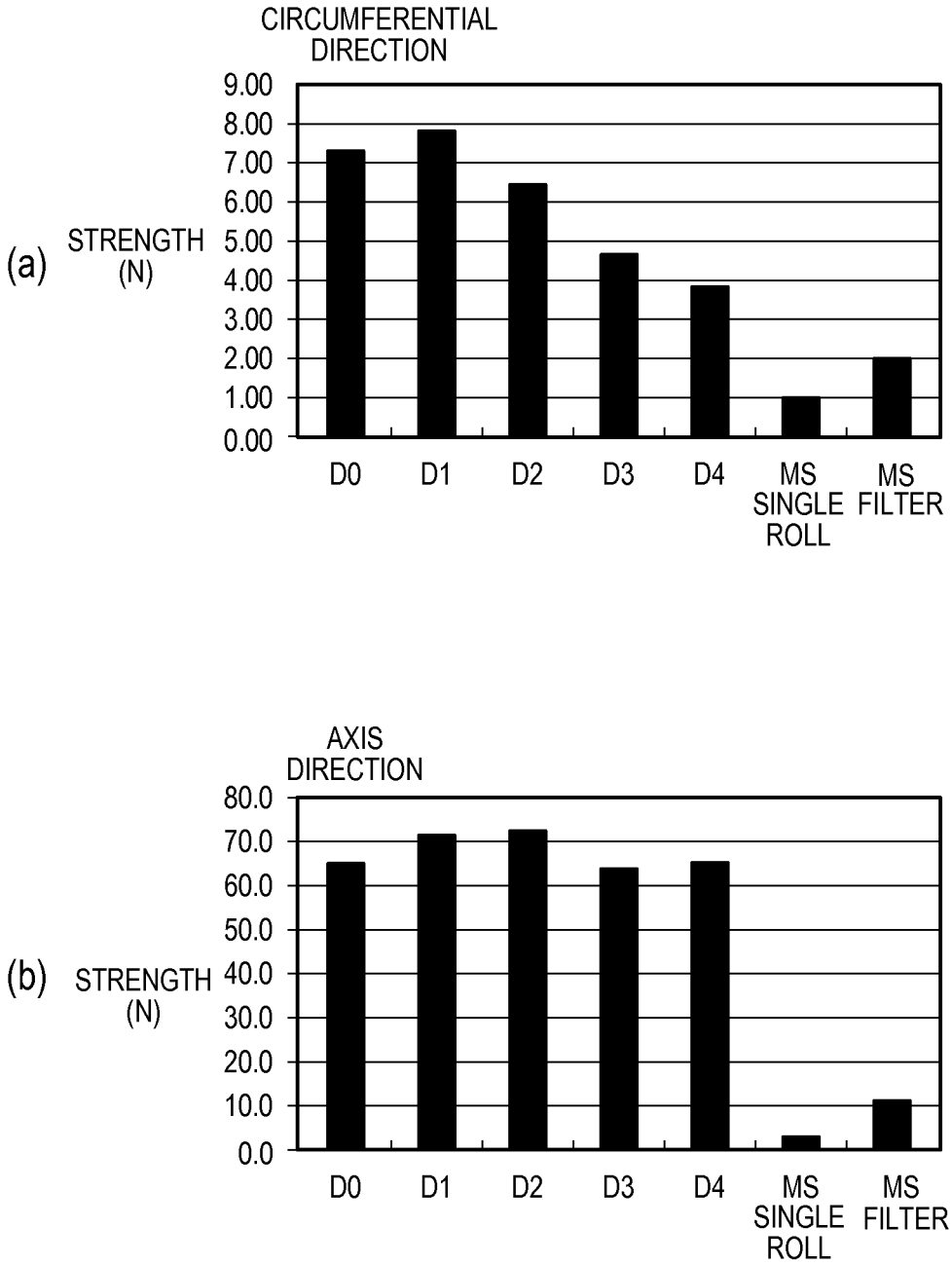
FIGS. 10(*a*) and 10(*b*) are views illustrating a summary of measurement results of stiffness of paper tubes where depths of grooves formed by cutting in a linear manner are changed.

The measurement results of the planospiral paper tubes manufactured by using the samples D0 and D1 to D4 are shown in Table 4, and the measurement results of the planospiral paper tubes manufactured by using the samples D0 and D5 to D8 are shown in Table 5. The graphs of the measurement results are shown in FIGS. 10(*a*), 10(*b*), 11(*a*) and 11(*b*).

As a comparative example, the stiffness of a single rolled portion (shredded tobacco filled portion) and a filter portion of the general cigarette MS in the marketplace was measured by the method same as the planospiral paper tubes, and the measurement result is shown.

TABLE 4

| | | D0 | D1 | D2 | D3 | D4 | MS Single Roll | MS Filter |
|---|---|---|---|---|---|---|---|---|
| Depth of Blade (μm) | | 0 | 150 | 170 | 200 | 220 | — | — |
| Measurement Result | Circumferential Direction | 7.31 | 7.80 | 6.43 | 4.66 | 3.87 | 1.04 | 2.02 |
| | Axis Direction | 65.6 | 71.9 | 72.8 | 64.4 | 65.6 | 3.44 | 11.7 |

TABLE 5

| | | D0 | D5 | D6 | D7 | D8 | MS Single Roll | MS Filter |
|---|---|---|---|---|---|---|---|---|
| Depth of Blade (μm) | | 0 | 150 | 170 | 200 | 220 | — | — |
| Measurement Result | Circumferential Direction | 7.31 | 5.56 | 4.00 | 4.04 | 4.24 | 1.04 | 2.02 |
| | Axis Direction | 65.6 | 72.1 | 71.5 | 67.8 | 72.9 | 3.44 | 11.7 |

Figure 11:
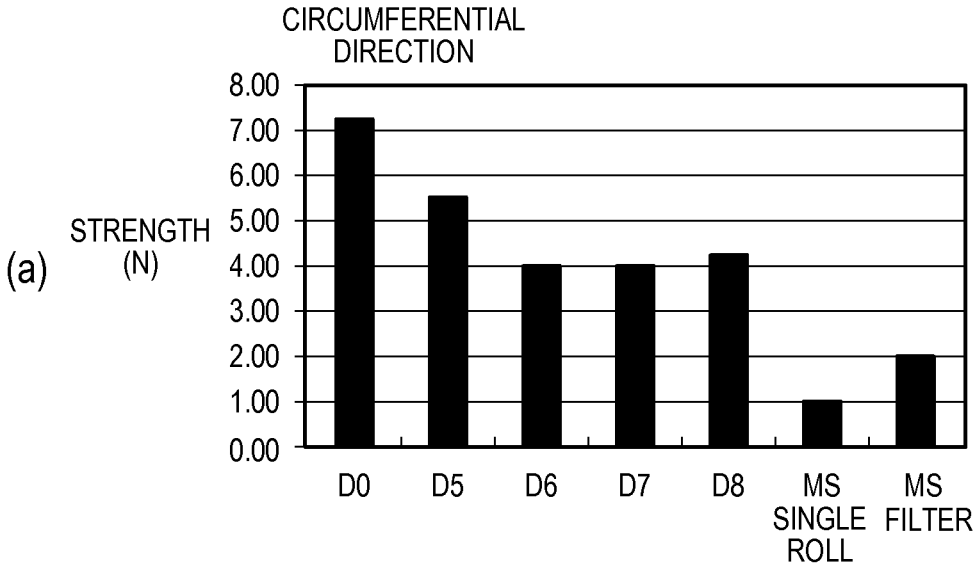
FIGS. 11(*a*) and 11(*b*) are views illustrating a summary of measurement results of stiffness of paper tubes where depths of grooves formed by recessed indentation lines.
Figure 11:
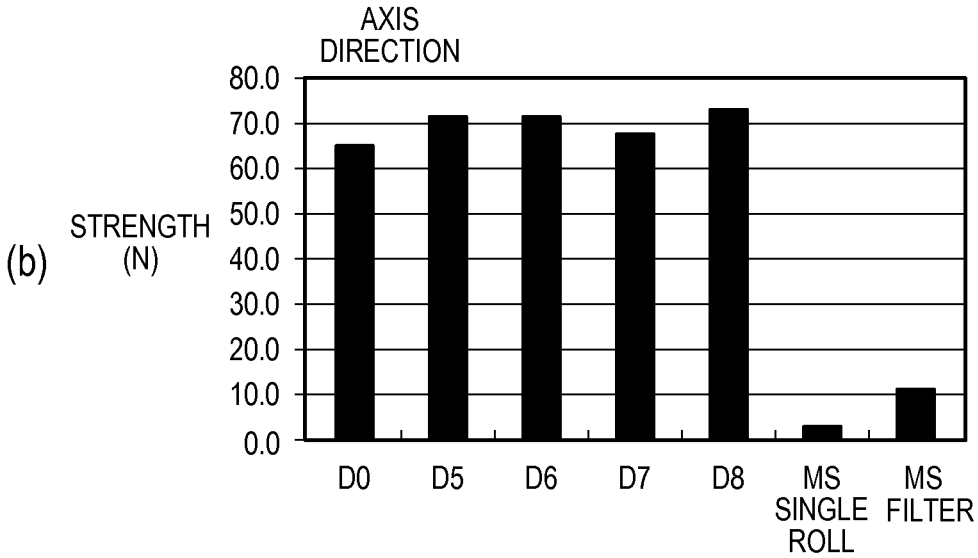

FIGS. 10(*a*) and 10(*b*) are views illustrating measurement results for the half cut groove forming process correspond to Table 4 and FIGS. 11(*a*) and 11(*b*) are views illustrating measurement results for the indentation line forming process correspond to Table 5. As same as FIGS. 9(*a*) and 9(*b*), for each of the thick papers D1 to D8 and the comparative example, FIGS. 10 (*a*) and 11 (*a*) show a graph of strength (N) in the circumferential direction and FIGS. 10 (*b*) and 11 (*b*) show a graph of strength (N) in the axis direction.

As shown in FIGS. 9 (*a*) and 9 (*b*), for the stiffness of the planospiral paper tubes formed of the thick papers where the groove forming process is applied, the stiffness in the circumferential direction has slightly low tendency but the stiffness in the axis direction is same level as an initial thick paper (before the groove forming process).

As evidenced from FIGS. 10 (*a*), 10 (*b*), 11(*a*) and 11 (*b*), in both case of the two groove forming process, the stiffness in the circumferential direction has tendency that becomes lower as the depth of the groove increases, but it has significantly higher compared to the single rolled cigarette of the comparative example, it was confirmed that sufficient strength can be obtained for the holder of the flavor inhaler. As to the method for forming the grooves, it was confirmed that sufficient strength can be obtained by using any one of methods.

Specifically, evidenced from FIGS. 10 (*a*) and 11 (*a*), the half cut groove forming process can achieve the higher strength in the circumferential direction compared to the indentation line forming process in a range where the depth of groove is 60% to 80% of the thickness of the thick paper.

As described above, the paper tube according to the present invention can reduce the influence caused by the sorption of the flavor component by the adhesive since the used amount of the adhesive is few, and also reduce the detachment of the overlapped portion and the formation of the creases on the surface of the paper tube, it is preferable for the flavor inhaler.

The flavor inhaler adopting the above paper tube as the holder can stably keep the shape by the strength of the paper tube and suppress the influence of the adhesive to the flavor, the user can enjoy the flavor using said flavor inhaler. Further, the flavor inhaler can be manufactured in low cost compared to a case where the holder is made of other material such as a metal or a plastic.

Figure 12:
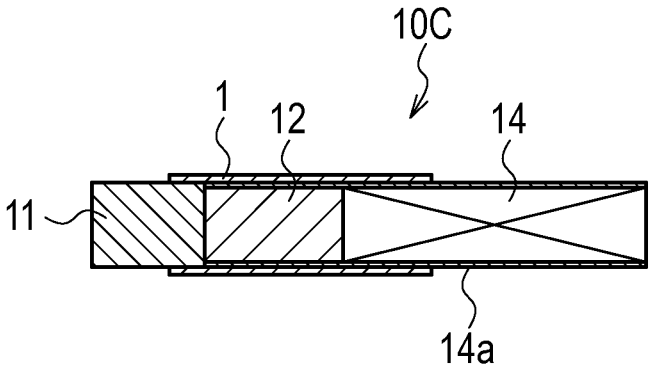
FIG. 12 is a view illustrating a flavor inhaler of an original type adopting the paper tube shown in FIG. 1 as a paper tube holder.

In the above description, the paper tube, which is used for the paper tube holder of so-called flavor inhalers 10A and 10B of smokeless type having the cooling element 13 shown in FIGS. 3 and 4, is described as the preferable embodiment, but the above described paper tube 1 can be used for the flavor inhaler 10C of original type shown in FIG. 12 which is not provided with the cooling element. Note that the duplicated description is omitted by using the same reference numeral to a composition same as FIGS. 3 and 4.

When the paper tube is used as the annular reinforce member of the hollow portion provided inside the flavor inhaler or used as the positioning member of the composition elements such as the heat source or the flavor generating source, following configuration may adopted. The configuration is a configuration where the thick paper is curved and the edge ends (sides) of the side edge portions facing each other are simply contacted, or a configuration of arch shape where the thick paper is curved and the curved thick paper has a circumferential length of ⅔ or more relative to the entire circumferential length of the hollow portion. The effect as the reinforce member or the positioning member may be expected in such a usage type as well as a case where the cylindrical shape is formed without using the adhesive.

The present invention described above is not limited to the aforementioned embodiments. The present invention may be applicable for various embodiments without departing from the scope of the invention.

The invention claimed is:

1. A paper tube of a single layered thick paper formed into a cylindrical hollow body by curving a thick paper having a rectangular shape and gathering both side edge portions of the thick paper along a longitudinal direction, wherein:

the thick paper has a basis weight equal to 100 g/m$^2$ or more and equal to 300 g/m$^2$ or less, a thickness equal to 150 μm or more and equal to 500 μm or less, and a density equal to 0.5 g/cm$^3$ or more, and a diameter of the cylindrical hollow body is equal to 5 mm or more and equal to 8 mm or less, a plurality of grooves parallel to an axis line of the cylindrical hollow body is formed on an outer surface or an inner surface of the cylindrical hollow body.

2. The paper tube according to claim 1, wherein an overlapped portion is formed by overlapping the side edge portions and adhering the both side edge portions.

3. The paper tube according to claim 2, wherein the side edge portions are adhered by an adhesive for a food-related material selected from a group of a CMC-Na, a vinyl acetate, an EVA, a pullulan and a pectin.

4. The paper tube according to claim 2, wherein the grooves each include a cut portion of a linear shape formed by removing a part of the thick paper in a linear manner along the axis line of the cylindrical hollow body.

5. The paper tube according to claim 4, wherein the grooves are arranged having equal intervals in a circumferential direction of the cylindrical hollow body.

6. The paper tube according to claim 5, wherein a depth of each groove is equal to 60% or more and equal to 90% or less of the thickness of the thick paper, and an interval between each pair of grooves adjacent to each other is equal to 1 mm or more and equal to 2 mm or less.

7. The paper tube according to claim 2, wherein the grooves each include a recessed indentation of linear shape formed on the surface of the thick paper along the axis line of the cylindrical hollow body.

8. The paper tube according to claim 7, wherein the grooves are arranged having equal intervals in a circumferential direction of the cylindrical hollow body.

9. The paper tube according to claim 8, wherein a depth of each groove is equal to 60% or more and equal to 90% or less of the thickness of the thick paper, and an interval between each pair of grooves adjacent to each other is equal to 1 mm or more and equal to 2 mm or less.

10. The paper tube according to claim 2, wherein the grooves are arranged having equal intervals in a circumferential direction of the cylindrical hollow body.

11. The paper tube according to claim 10, wherein a depth of each groove is equal to 60% or more and equal to 90% or less of the thickness of the thick paper, and an interval between each pair of grooves adjacent to each other is equal to 1 mm or more and equal to 2 mm or less.

12. The paper tube according to claim 1, wherein the cylindrical hollow body is formed by abutting facing edge ends of the side edge portions without forming an overlapped portion and by adhering the side edge portions using a sealing member bridging the side edge portions.

13. The paper tube according to claim 12, wherein the grooves each include a cut portion of a linear shape formed by removing a part of the thick paper in a linear manner along the axis line of the cylindrical hollow body.

14. The paper tube according to claim 13, wherein the grooves are arranged having equal intervals in a circumferential direction of the cylindrical hollow body.

15. The paper tube according to claim 14, wherein a depth of each groove is equal to 60% or more and equal to 90% or less of the thickness of the thick paper, and an interval between each pair of grooves adjacent to each other is equal to 1 mm or more and equal to 2 mm or less.

16. The paper tube according to claim 12, wherein the grooves each include a recessed indentation of linear shape formed on the surface of the thick paper along the axis line of the cylindrical hollow body.

17. The paper tube according to claim 16, wherein the grooves are arranged having equal intervals in a circumferential direction of the cylindrical hollow body.

18. The paper tube according to claim 17, wherein a depth of each groove is equal to 60% or more and equal to 90% or less of the thickness of the thick paper, and an interval between each pair of grooves adjacent to each other is equal to 1 mm or more and equal to 2 mm or less.

19. The paper tube according to claim 12, wherein the grooves are arranged having equal intervals in a circumferential direction of the cylindrical hollow body.

20. The paper tube according to claim 19, wherein a depth of each groove is equal to 60% or more and equal to 90% or less of the thickness of the thick paper, and an interval between each pair of grooves adjacent to each other is equal to 1 mm or more and equal to 2 mm or less.

21. The paper tube according to claim 12, wherein the side edge portions are adhered by an adhesive for a food-related material selected from a group of a CMC-Na, a vinyl acetate, an EVA, a pullulan and a pectin.

22. The paper tube according to claim 1, wherein the grooves each include a cut portion of a linear shape formed by removing a part of the thick paper in a linear manner along the axis line of the cylindrical hollow body.

23. The paper tube according to claim 22, wherein the grooves are arranged having equal intervals in a circumferential direction of the cylindrical hollow body.

24. The paper tube according to claim 23, wherein a depth of each groove is equal to 60% or more and equal to 90% or less of the thickness of the thick paper, and an interval between each pair of grooves adjacent to each other is equal to 1 mm or more and equal to 2 mm or less.

25. The paper tube according to claim 1, wherein the grooves each include a recessed indentation of linear shape formed on the surface of the thick paper along the axis line of the cylindrical hollow body.

26. The paper tube according to claim 25, wherein the grooves are arranged having equal intervals in a circumferential direction of the cylindrical hollow body.

27. The paper tube according to claim 26, wherein a depth of each groove is equal to 60% or more and equal to 90% or less of the thickness of the thick paper, and an interval between each pair of grooves adjacent to each other is equal to 1 mm or more and equal to 2 mm or less.

28. The paper tube according to claim 1, wherein the grooves are arranged having equal intervals in a circumferential direction of the cylindrical hollow body.

29. The paper tube according to claim 28, wherein a depth of each groove is equal to 60% or more and equal to 90% or less of the thickness of the thick paper, and an interval between each pair of grooves adjacent to each other is equal to 1 mm or more and equal to 2 mm or less.

30. The paper tube according to claim 1, wherein the thick paper is made by a paper making process without using a binder.

31. A flavor inhaler comprising:

the paper tube according to claim 1, a heat source held at a one end of the paper tube, and a flavor generating source arranged in the paper tube, which generates a flavor using heat generated from the heat source.

32. The flavor inhaler according to claim 31 comprising:

a cooling element arranged between the heat source and the flavor generating source, which cools air that is heated by the heat source and that travels toward the flavor generating source.

33. The flavor inhaler according to claim 31, wherein the flavor generating source includes a crushable capsule housing a flavor component.

34. The flavor inhaler according to claim 31, wherein the paper tube covers and holds the heat source, a cooling element and the flavor generating source.

35. A paper tube of a single layered thick paper formed into a cylindrical hollow body by curving a thick paper having a rectangular shape and gathering both side edge portions of the thick paper along a longitudinal direction, wherein:

the thick paper has a basis weight equal to 100 $g/m^2$ or more and equal to 300 $g/m^2$ or less, a thickness equal to 150 μm or more and equal to 500 μm or less, and a density equal to 0.5 $g/cm^3$ or more, and a diameter of the cylindrical hollow body is equal to 5 mm or more and equal to 8 mm or less, a plurality of grooves having a lattice shape relative to an axis line of the cylindrical hollow body is formed on an outer surface or an inner surface of the cylindrical hollow body.

* * * * *